US009016206B2

(12) United States Patent
Willner

(10) Patent No.: US 9,016,206 B2
(45) Date of Patent: Apr. 28, 2015

(54) ARMOR PIERCING PROJECTILE

(71) Applicant: Byron J. Willner, Hot Springs, VA (US)

(72) Inventor: Byron J. Willner, Hot Springs, VA (US)

( * ) Notice: Subject to any disclaimer, the term of this patent is extended or adjusted under 35 U.S.C. 154(b) by 0 days.

(21) Appl. No.: 13/952,645

(22) Filed: Jul. 28, 2013

(65) Prior Publication Data

US 2015/0027336 A1 Jan. 29, 2015

(51) Int. Cl.
*F42B 12/08* (2006.01)

(52) U.S. Cl.
CPC ..... *F42B 12/08* (2013.01)

(58) Field of Classification Search
USPC ..... 102/518, 519, 364
See application file for complete search history.

(56) References Cited

U.S. PATENT DOCUMENTS

| | | | | |
|---|---|---|---|---|
| 3,981,243 | A * | 9/1976 | Doris, Jr. | 102/364 |
| 6,691,622 | B2 * | 2/2004 | Zavitsanos et al. | 102/364 |
| 6,843,179 | B2 * | 1/2005 | Hunn et al. | 102/519 |
| 2005/0211126 | A1 * | 9/2005 | Hurley | 102/517 |

* cited by examiner

*Primary Examiner* — Reginald Tillman, Jr.
(74) *Attorney, Agent, or Firm* — Alfred F. Hoyte, Jr.

(57) ABSTRACT

A projectile designed to penetrate a liquid filled vessel and react with the liquid contained within the vessel. The projectile is formed of a narrow tapered nose portion with a thin liquid soluble casing which contains a reactive material. The nose portion is formed of spent radioactive material and is connected to an axially extending centrally positioned rod having a pressure plate on its distal end. The projectile casing contains potassium or other material which reacts with water or other liquid to create an explosion once the casing has dissolved within the vessel.

6 Claims, 6 Drawing Sheets

ARMOR PIERCING PROJECTILE

BACKGROUND OF THE INVENTION

1. Field of the Invention

The present invention relates to armor piercing projectiles. More particularly, the invention relates to armor piercing projectiles designed for particular volatility when impacting submerged or liquid filled targets.

2. Description of the Prior Art

U.S. Pat. No. 8,122,833 issued to Nielson et al. discloses a projectile composed of a reactive material, with at least some of the reactive material positioned exteriorly of the missile.

U.S. Pat. No. 3,981,243 issued to Doris et al. discloses a projectile containing an incendiary mix both within and on the nose portion of the projectile.

The present invention is directed to a projectile designed to penetrate a liquid filled vessel and react with the liquid contained within the vessel. The projectile is formed of a narrow tapered nose portion with a thin liquid soluble casing which contains a reactive material. The nose portion is formed of spent radioactive material and is connected to an axially extending centrally positioned rod having a pressure plate on its distal end. The projectile casing contains potassium or other material which reacts with water or other liquid to create an explosion once the casing has dissolved within the vessel.

SUMMARY OF THE INVENTION

It is a major object of the invention to provide a projectile for firing upon liquid filled vessels.

It is another object of the invention to provide a projectile having a narrowly tapered piercing tip.

It is another object of the invention to provide a projectile having a tip formed of spent radioactive material.

It is another object of the invention to provide a projectile having an outer jacket or casing formed of a water soluble material.

It is another object of the invention to provide a projectile which contains a water reactive substance.

BRIEF DESCRIPTION OF THE DRAWINGS

Various other objects, features, and attendant advantages of the present invention will become more fully appreciated as the same becomes better understood when considered with the accompanying drawings, in which like reference characters designate the same or similar parts throughout the several views, and wherein.

DETAILED DESCRIPTION OF THE PREFERRED EMBODIMENTS

Figure 1:
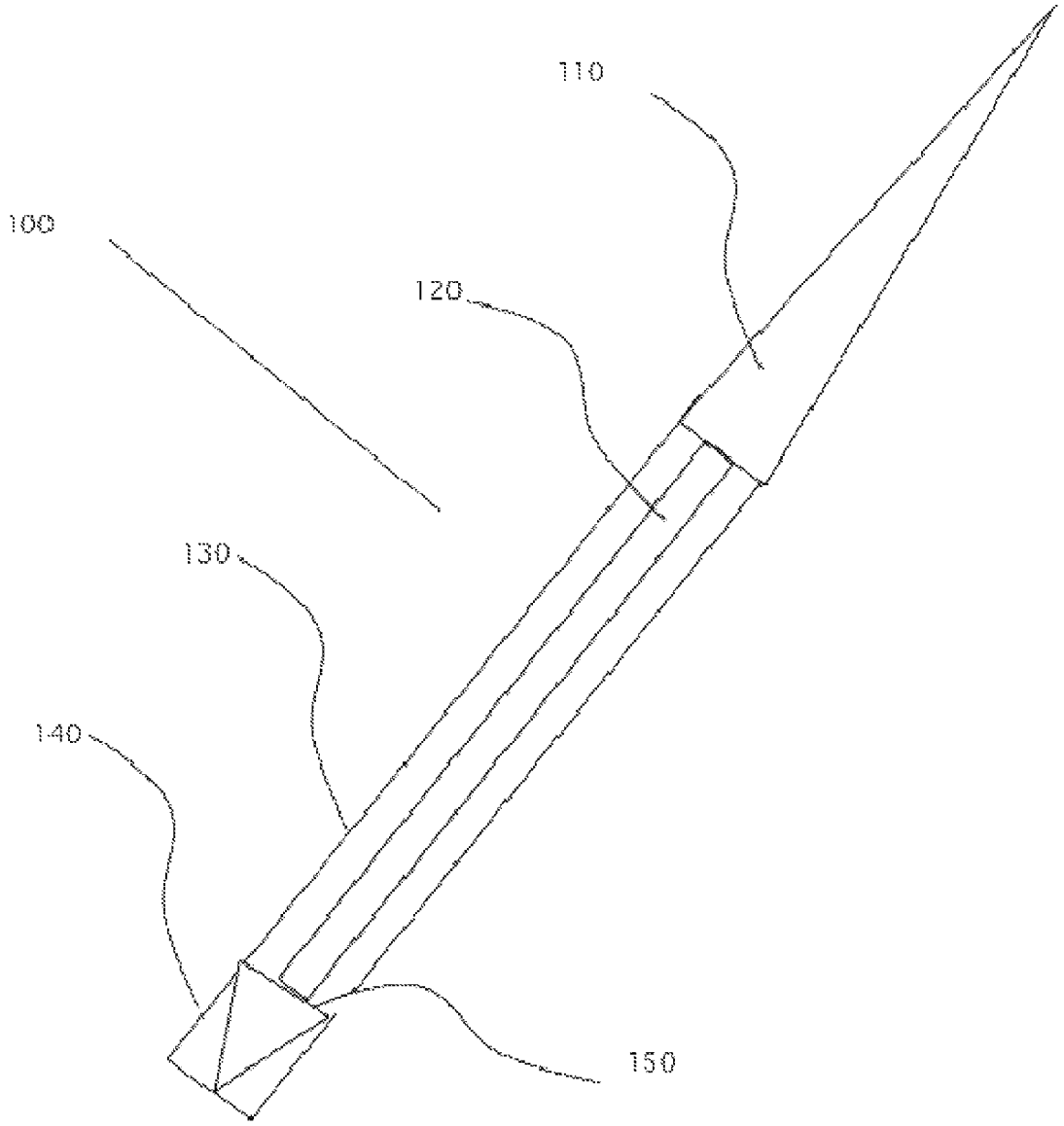
FIG. 1 shows a plan view of the projectile of the invention.
Figure 2:
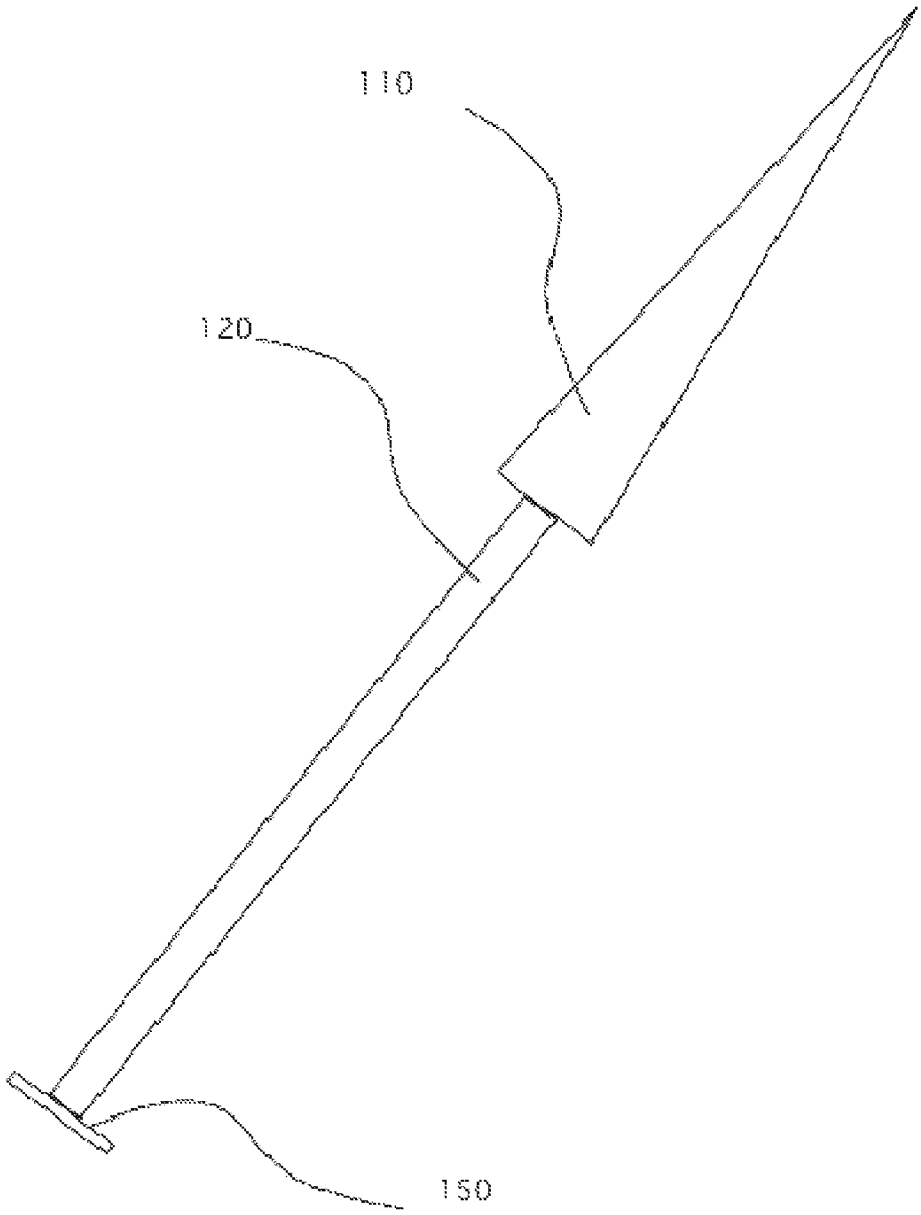
FIG. 2 is a plan view of the armor piercing mechanism of the invention.

Referring now to FIGS. 1-6, the projectile of the invention 100, with its various applications and embodiments, is illustrated. The projectile 100 has a main body 130 or casing which is generally cylindrical with a hollow interior. A key aspect of the invention is that the projectile is particularly adapted for attacking water or inert liquid filled vessels. Any military or civilian target which is filled with water such as a water tank or water supply for a land or oceangoing vessel can be targeted and compromised by the projectile 100. To that end, the casing 100 is formed of a material which is water soluble.

The interior of the casing 130 is filled with potassium or other material which has high volatility in liquid. When the projectile strikes, the casing 130 dissolves dispersing the potassium into the liquid contained in the vessel thereby causing destruction of the vessel.

The tip or nose 110 of the projectile 100 is solid and tapers to a fine point to allow for penetration into and through the typically thin or lightly armored walls of the target vessel. In a preferred embodiment, the nose 110 is made of spent radioactive material and is of sufficient hardness to penetrate at least light armor or a relatively thin metallic barrier. Alternatively, the nose 110 is made of titanium or other hard metal. An axial connecting rod 120 extends to the rear of the projectile 100 and terminates in a disc shaped pressure plate 150. The pressure plate 150 is pushed forward by compressed gas or other propellant as described later, which pushes the nose 110 forward.

In operation, the missile 100 is fired into the vessel, with the tip 110 acting to pierce the containment wall or hull of the vessel. Once inside of the vessel, the water soluble casing 130 quickly dissolves and disperses the potassium or other reactant into the liquid thereby causing an explosive reaction.

The projectile 100 is designed to be fired from a large caliber compressed air/gas rifle or handgun without any modification being made to the rifle or handgun. To that end, the projectile is relatively small, about ½ to ⅝ inches in diameter (and of commensurate length), and is contained within a compressed gas casing 300. The concept of the projectile 100 is not limited to handheld launchers, and may be used with a suitable launcher of any size commensurate with the size of the projectile for use against larger targets. Two pairs of fins 140 extend from the back end of the projectile 100 and may be curved or otherwise configured to optimize flight stability.

Figure 3:
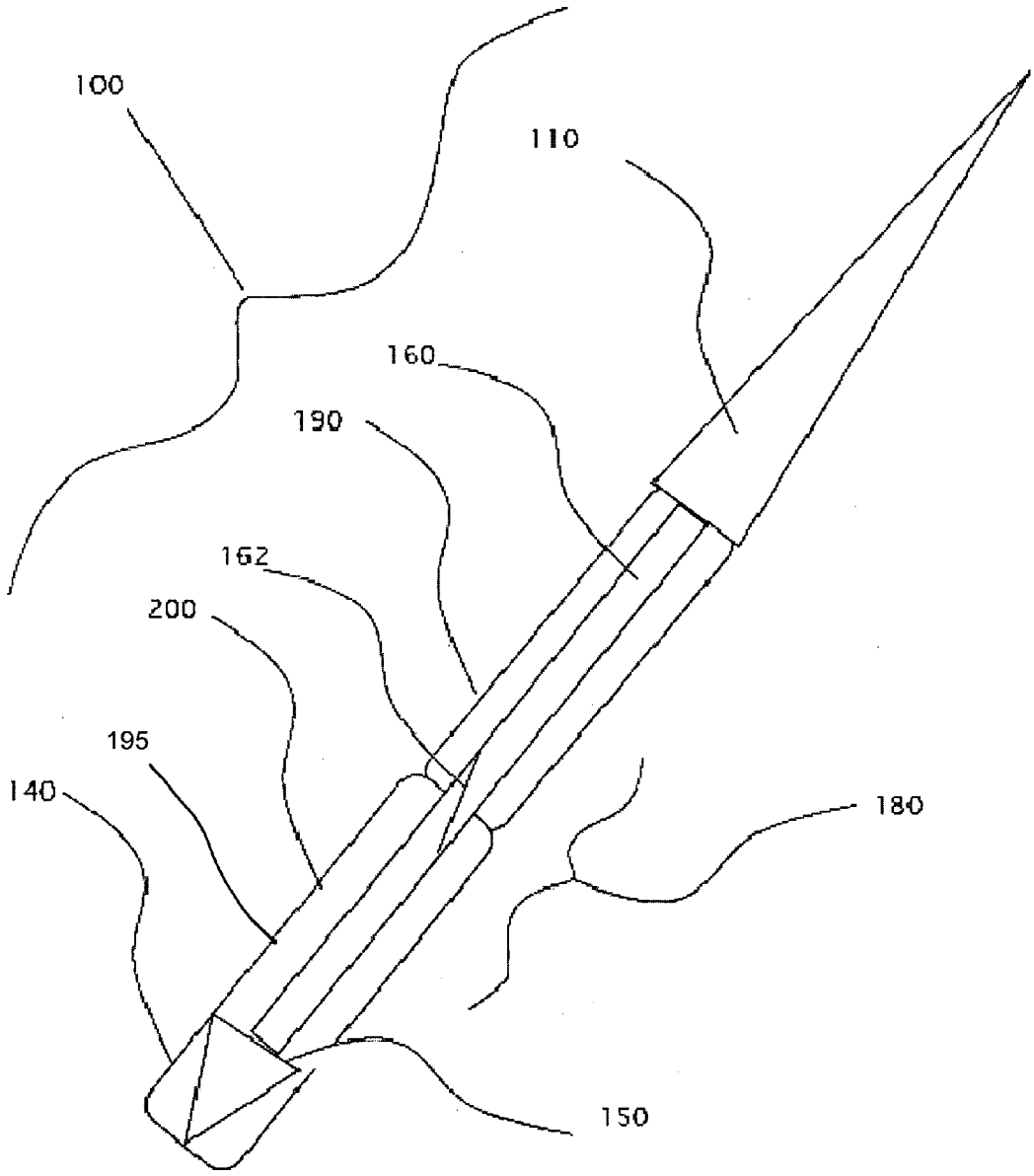
FIG. 3 is a plan view of an alternative embodiment of the projectile of the invention.
Figure 4:
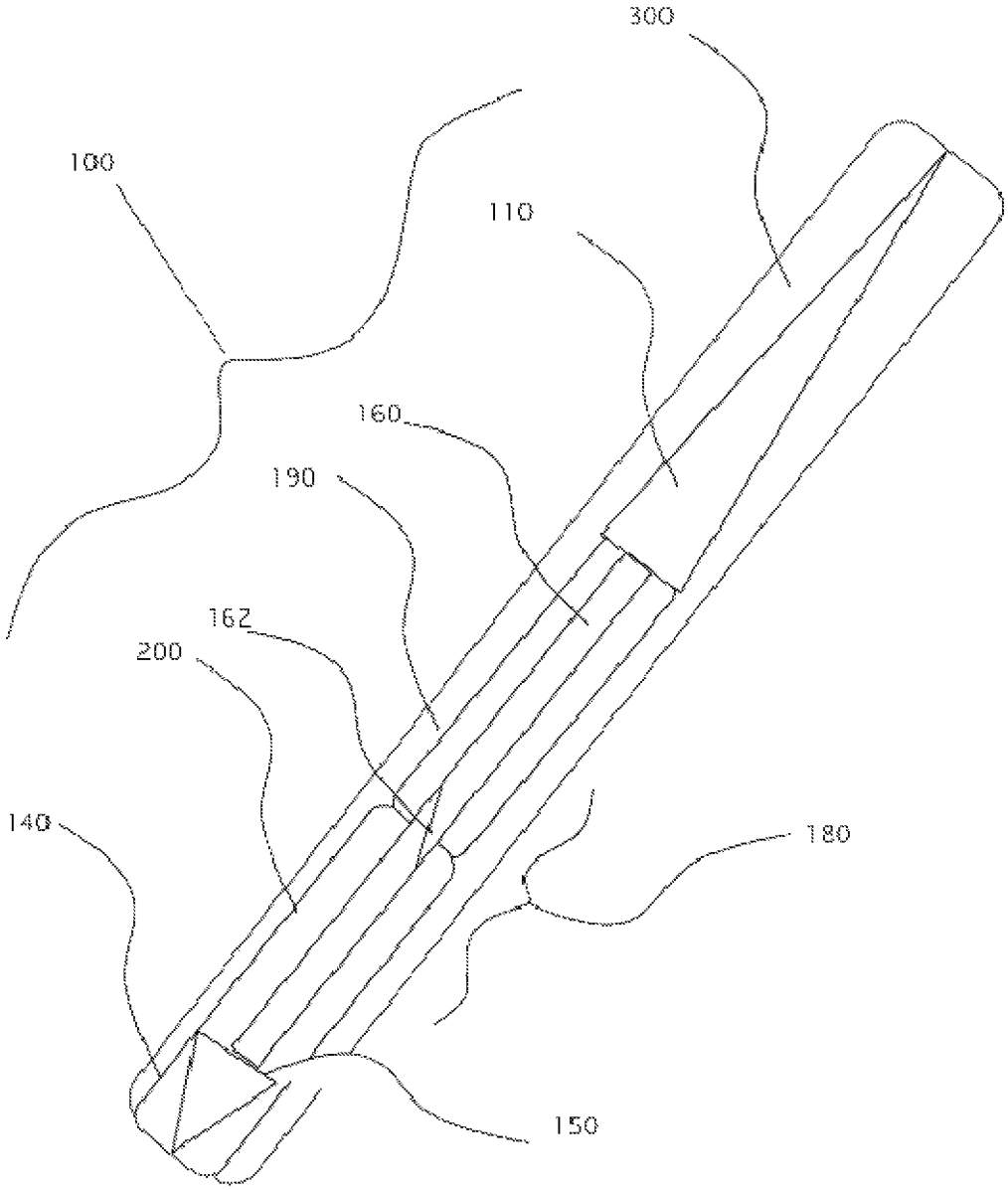
FIG. 4 is a plan view of a storage casing which can be used with either embodiment of the invention.

An alternative embodiment of the projectile is shown in FIGS. 3 and 4. This embodiment 200 has a main body 180 comprised of two separate tubular enclosures. Enclosure 190 is filled with water and enclosure 195 is filled with an explosive material. The enclosures 190, 195 are each preferably of unitary construction with a sealing barrier therebetween so that the main body has a smooth exterior to allow for predictable aerodynamics. Center rod 160 is frangible and has its fracture point positioned about the sealing barrier. The center rod 160 extends into and through both enclosures 190, 195. When the rod 160 is broken, the fractured rod 160 ruptures both enclosures 190, 195 with the resulting interaction of the explosive material, which may be potassium, and water creating an explosive force.

The projectile 100, 200 of either embodiment is jacketed in a casing 180 formed of aluminum or other thin metal at least at the base portion, proximate fins 140. The fins 140 have pointed tips formed at the rearmost portion which are adapted for rupturing casing 180 without affecting the flight of the projectile 100, 200.

Figure 5:
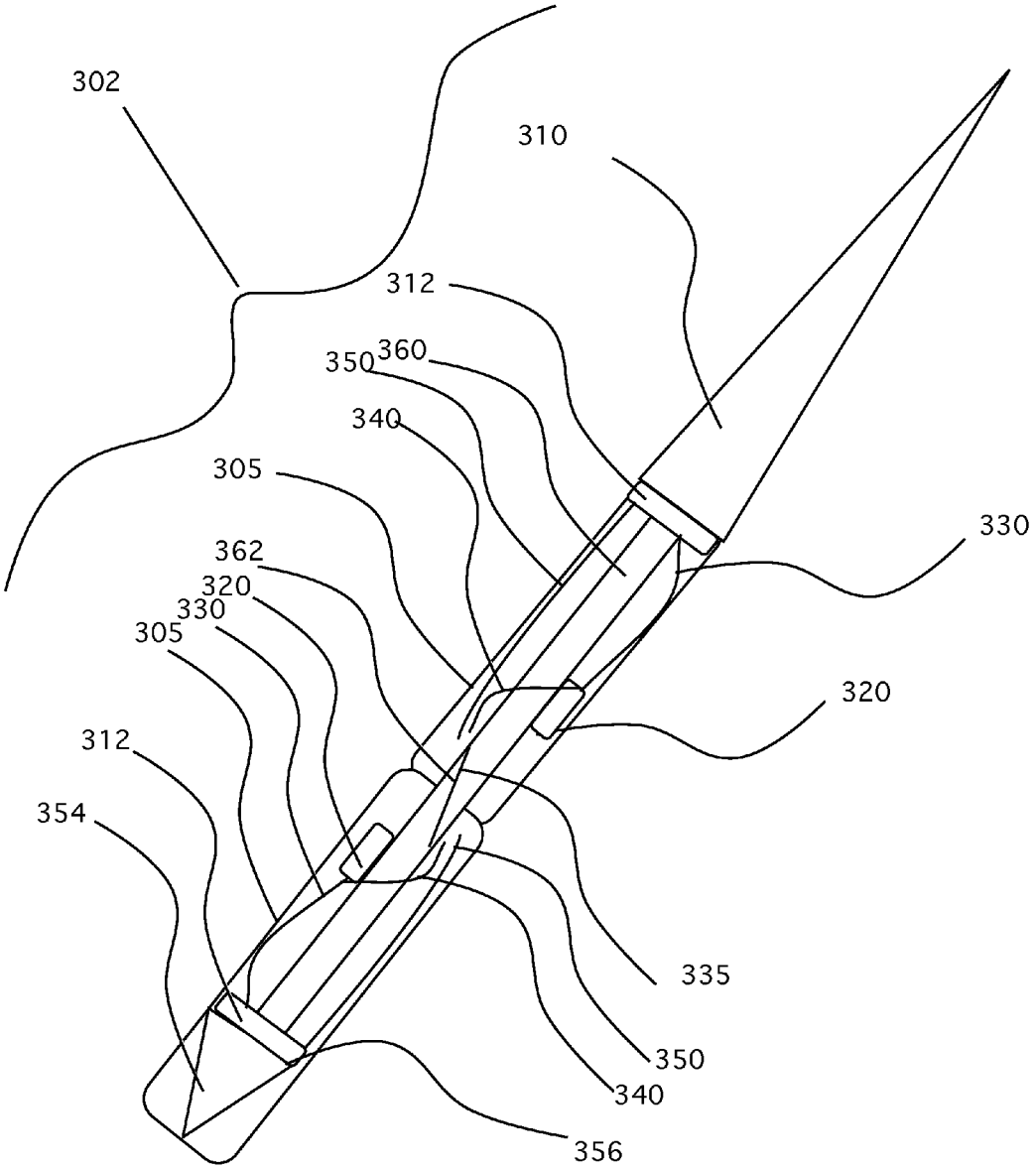
FIG. 5 is a plan view of a third embodiment of the projectile of the invention.

Referring now to FIG. 5, a third embodiment of the invention, generally indicated by the numeral 302, is shown. This embodiment 302 relies on impact triggering to close detonation switches formed by redundant contacts 340, 350 positioned in the identical, axially aligned, explosive containers 305 as will be explained in more detail later. The projectile 302 is effective as an armor piercing missile against any armored target, and may be used to penetrate bullet proof glass. The projectile 302 is the same size as the other embodiments, and is contained within also contained within compressed gas casing 300.

The projectile tip or nose 310 of the projectile 302 is solid and tapers to a fine point to allow for penetration into and through the typically thin or lightly armored walls of the target vessel. As in the previous embodiments, the nose 310 may be made of spent radioactive material and is of sufficient hardness to penetrate at least light armor or a relatively thin metallic barrier. As previously stated, the projectile 302 has a main body 380 comprised of two separate tubular enclosures 305 contained within casing 300. The enclosures 305 both contain electrically ignitable explosive materials. The explosive materials may be gunpowder, but preferably a very high yield explosive is used due to the relatively small size of the projectile 302. Center rod 360, which extends into and through both enclosures 305, is frangible and has its fracture point 362 positioned about the meeting point of the enclosures. Button batteries 312 are positioned proximate opposing ends of the projectile 302 for powering electronic ignition of the explosive material. When fractured as upon impact, the projectile detonates by the closure of contacts 340, 350 which triggers the detonator 320.

Detonators 320 are small but otherwise conventional electrical detonators which are positioned within respective enclosures 305 preferably at about the axial midpoint thereof and abutting center rod 362. An ignition wire 330 is electrically connected between batteries 312 and detonators 320. Contacts 340 and 350 form a complete circuit when momentarily pressed together at impact, thereby sending the ignition pulse along wire 330.

The tail fins 354 and back plate 356 function as in the previous embodiments.

In operation, the projectile 302 is fired at an armored target and, upon impact, center rod 260 collapses, causing detonation by closing contacts 340, 350, or by one or both of the metallic tips 335 of the of the fractured center rod closing the respective detonation circuits of the enclosures 305.

Figure 6:
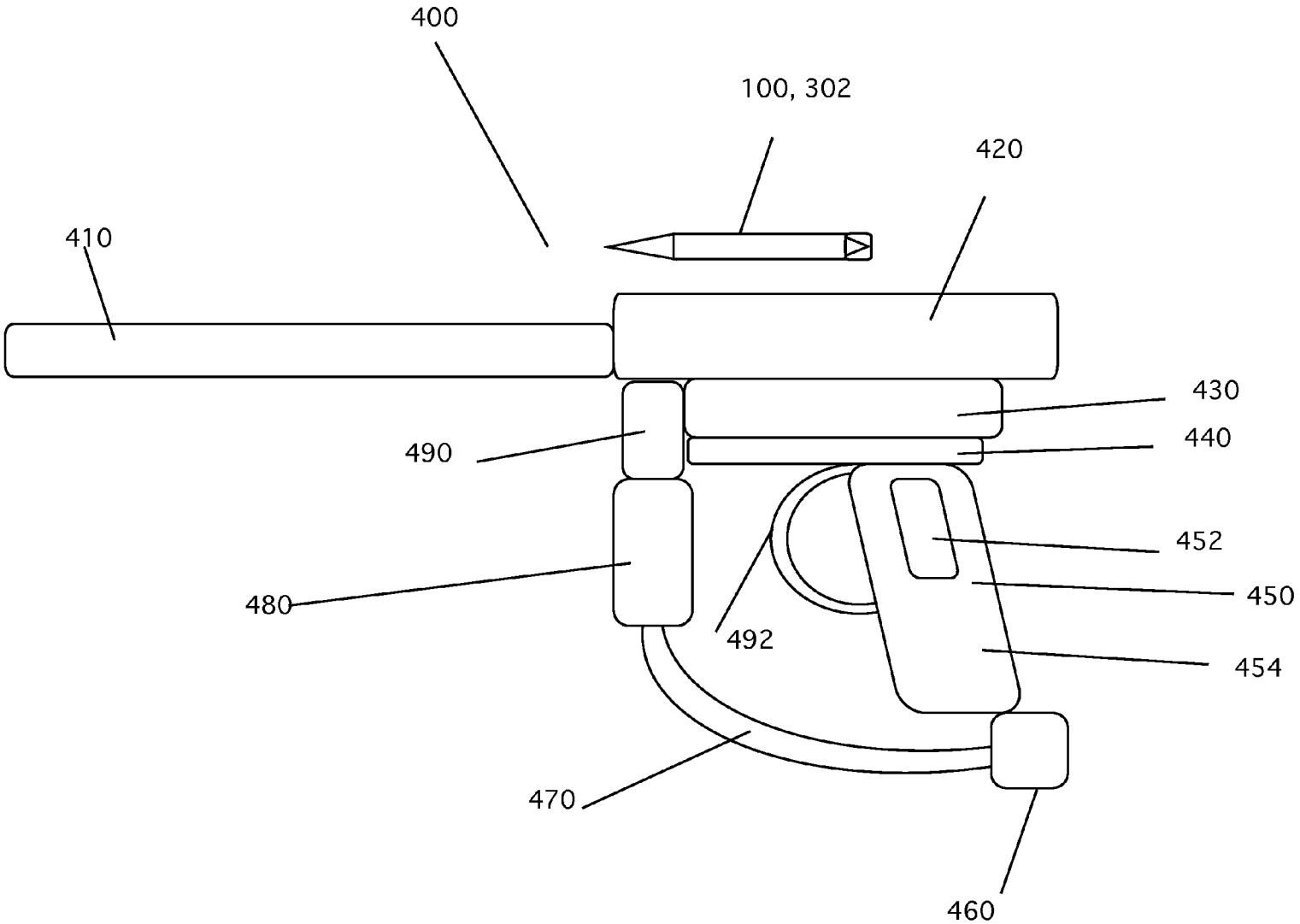
FIG. 6 is a plan view of the launcher used with the projectiles of the embodiments of FIGS. 1, 3, and 5.

Referring now to FIGS. 6, the projectile launcher 400 is shown. The launcher 400 includes a thumbprint or DNA reader interface which reads the thumbprint or DNA of the user and matches it to a stored image or pattern. If a match occurs the launcher 400 is operational. The projectiles are bar coded, the bar code being read by suitable electronic positioned in the firing chamber. The launcher 400 has previously stored, and constantly updated, via, e.g., WIFI, series of bar codes. If the bar code of the projectile matches the stored bar codes the launcher 400 is operational.

The launcher 400 is a compressed air gun having a barrel 410, which is connected to a receiver and bar code reader 420, the receiver 420 adapted for positioning a projectile 100, 200, 302. A receiver to grip interface 430, serves to connect the receiver to the grip 450 via grip connecting plate 440. Positioned on the grip is a thumb print exterior contact interface 452, which allows the user's thumb print to be read. An internal processor 454, which includes communication WIFI and a battery, processes the sensed thumbprint image and compares it to stored images, which may be acquired from a server via WIFI.

A gas cartridge receptacle 460 contains a gas cartridge and is in fluid communication with air hose 470. The air hose 470 is connected to expansion chamber 480, which allows air pressure to accumulate sufficiently to fire the projectile 100, 200, 302, the compressed air passing through vertical adapter to receiver 420 to fire the projectile in a manner well known in the art.

From the foregoing description, one skilled in the art can easily ascertain the essential characteristics of this invention and, without departing from the spirit and scope thereof, can make various changes and modifications of the invention to adapt it to various usages and conditions.

It is to be understood that the present invention is not limited to the sole embodiment described above, but encompasses any and all embodiments within the scope of the following claims:

I claim:

1. A projectile for penetrating and destroying liquid filled vessels comprising:
- a hollow main body or casing having a generally cylindrical shape;
- a narrowly tapered tip attached to and extending from an impact end of said casing,
- said tip having an integrally formed rod centrally positioned and extending axially into said casing and having a pressure plate positioned at its distal end;
- said casing formed of a water soluble material and containing a substance which has volatility in water, and said tip formed of spent radioactive material;
- whereby said projectile has particular effectiveness when striking said liquid filled vessels.

2. The projectile of claim 1 wherein said casing contains potassium.

3. The projectile of claim 1 wherein said tip is formed of spent nuclear material.

4. The projectile of claim 1 wherein said casing has first and second enclosures.

5. The projectile of claim 4 wherein said first enclosure contains potassium and said second enclosures contains water.

6. The projectile of claim 4 including a connecting rod positioned within said enclosures, where said connecting rod is frangible and adapted for simultaneously rupturing said two enclosures.

* * * * *